US006373181B1

(12) United States Patent
Vink et al.

(10) Patent No.: US 6,373,181 B1
(45) Date of Patent: Apr. 16, 2002

(54) DEFLECTION UNIT FOR A CATHODE RAY TUBE

(75) Inventors: Nicolaas G. Vink, Eindhoven; Willem M. Van Alphen, Veldhoven, both of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/488,032

(22) Filed: Jan. 20, 2000

(30) Foreign Application Priority Data

Jan. 22, 1999 (EP) ..... 99200188

(51) Int. Cl.[7] ..... H01H 1/00; H01J 29/70

(52) U.S. Cl. ..... 313/440; 335/210; 335/213; 348/831

(58) Field of Search ..... 313/440; 335/210, 335/217, 211, 213, 296, 299, 209; 348/831

(56) References Cited

U.S. PATENT DOCUMENTS 5,838,099 A * 11/1998 Hichiwa et al. ..... 335/213
5,952,905 A * 9/1999 Kim et al. ..... 313/440 X
5,986,396 A * 11/1999 Verbunt et al. ..... 335/210

FOREIGN PATENT DOCUMENTS

| | | | | |
|---|---|---|---|---|
| EP | 0427182 | * | 5/1991 | ..... 313/440 |
| WO | WO9708728 | | 3/1997 | ..... H01J/9/236 |
| WO | WO9826574 | | 6/1998 | |

OTHER PUBLICATIONS

Patent Abstracts of Japan, Publication No. 0707382, "Deflection Yoke", dated Mar. 17, 1995.

* cited by examiner

*Primary Examiner*—Ashok Patel

(57) ABSTRACT

The invention relates to a deflection unit (10) for cathode ray tubes in which the external magnetic stray fields are further reduced and the sensitivity of the line deflection coils (17) is increased. This is done by applying a (preferably plastic deformable) magnetic material (56) in the first void spaces (52) between the wire strands (50) of the field deflection coils (18) and/or the second void spaces (54) between the field deflection coils (18) and the yoke ring (22). The plastic deformable magnetic material (56) can be additionally used for adhering the yoke ring (22) to the field deflection coils (18).

8 Claims, 1 Drawing Sheet

DEFLECTION UNIT FOR A CATHODE RAY TUBE

Figure 1:
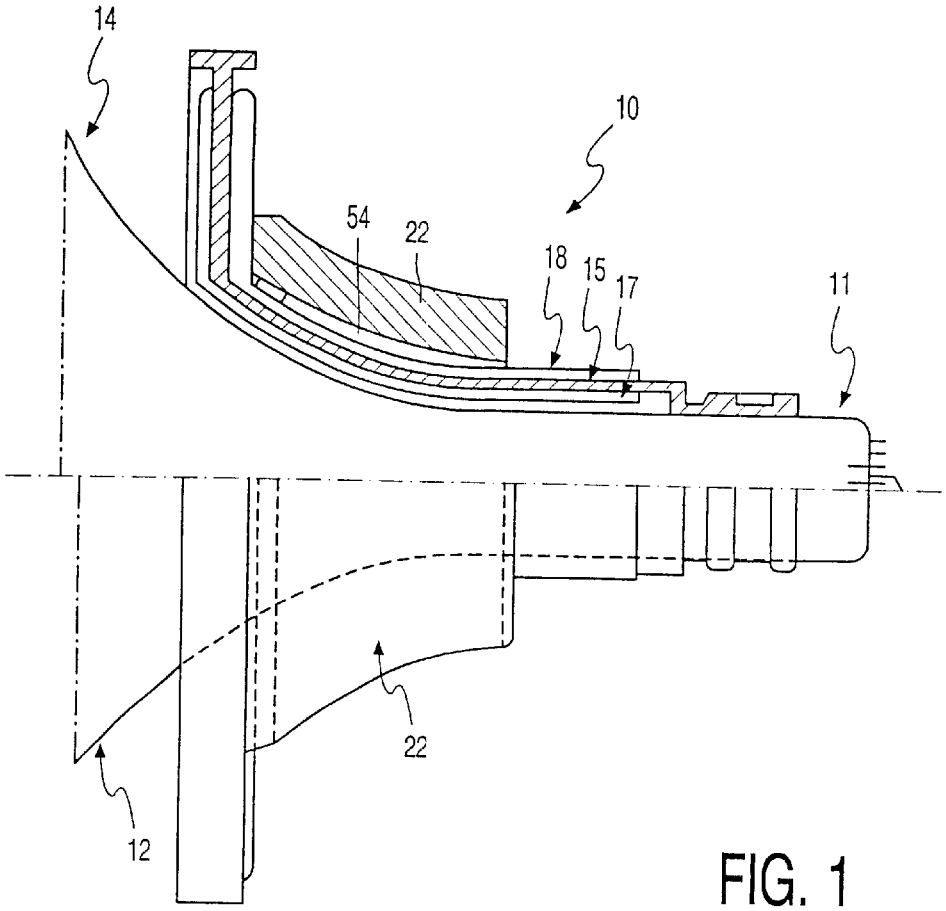

The invention relates to a deflection unit for a cathode ray tube, which deflection unit comprises a line deflection coil, a field deflection coil surrounding the line deflection coil, the field deflection coil comprising wire strands and having first void spaces between the wire strands, and a yoke ring surrounding the field deflection coil, second void spaces being present between the field deflection coil and the yoke ring.

The invention also relates to a cathode ray tube comprising such a deflection unit.

The invention further relates to a method of manufacturing a deflection unit for a cathode ray tube.

A deflection unit comprising a field deflection coil and a line deflection coil, in which the field deflection coil comprises wire strands and has void spaces between the wire strands, is known from WO-A 98/26574. A deflection unit of this type is generally constructed in such a way that the two coils are mounted on a hollow support (one on the inner side and one on the outer side) and that a yoke ring surrounds these coils. The purpose of the yoke ring is to short-circuit the magnetic lines of flux outside the coils, which are generated by the field deflection coils during operation. The yoke ring thus reduces unwanted external magnetic stray fields. This also leads to an increase of the sensitivity of the line deflection. Although the presence of a yoke ring helps to reduce these magnetic stray fields, a further reduction is desired.

It is an object of the invention to provide a deflection unit for a cathode ray tube wherein the sensitivity of the line deflection is improved.

The deflection unit according to the invention is characterized in that the first and/or second void spaces are filled with a magnetic material. The application of a magnetic material in the first and/or second void spaces improves the short-circuiting of the magnetic lines of flux outside the line deflection coils, reduces the unwanted magnetic stray fields and increases the sensitivity of the line deflection.

An embodiment of the invention is characterized in that the magnetic material comprises a plastic deformable magnetic material. The use of a plastic deformable material provides a way of accurately filling the voids and proper adaptation to the local shape of the voids.

A further embodiment of the invention is characterized in that the deformable magnetic material comprises a resinous material, which comprises a filler of magnetic particles. This embodiment has the advantage that the concentration of magnetic particles may be freely chosen and can be optimized to the application.

A further embodiment of the invention is characterized in that the yoke ring is adhered to the field deflection coil by means of the resinous material. This embodiment has the advantage that an additional adhesive necessary for connecting the yoke ring to the field deflection coil is not required; this helps to reduce the cost price of the deflection unit.

A second aspect of the invention provides a cathode ray tube assembly comprising such a deflection unit.

A third aspect of the invention provides a method of manufacturing such a deflection unit as defined in claim 6.

These and other aspects of the invention will be elucidated with reference to the embodiments described hereinafter.

Figure 2:
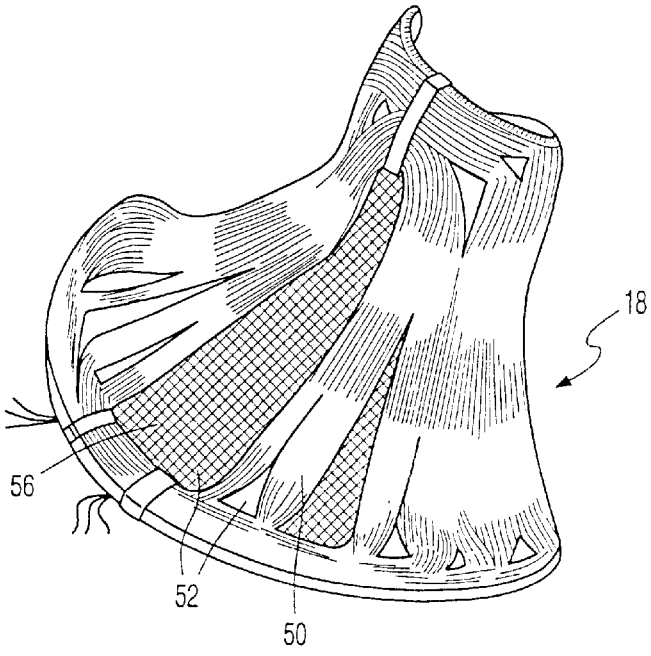

In the drawings,

FIG. 1 shows schematically, partly in a cross-section, partly in a side elevation, a part of a cathode ray tube with an embodiment of the deflection unit according to the invention, and FIG. 2 is a perspective view of a field deflection coil according to the invention.

In general, like reference numerals identify like elements.

Referring to FIG. 1, the deflection unit 10 is shown mounted on the glass envelope of a cathode ray tube 14 at the region between a neck 11 and a cone portion 12 of the envelope 14. The deflection unit 10 comprises a coil support 15 of generally frusto-conical shape which carries on its inner side, adjacent the envelope surface, a set of two line (horizontal) deflection coils 17, and on its outer side a set of two field (vertical) deflection coils 18, one of which is shown in FIG. 2, showing in particular first void spaces between the wire strands of the coil.

The coil support 15 together with the sets of deflection coils 17 and 18 secured thereto form a deflection coil assembly. A hollow yoke ring 22, in the shape of a flared annulus conforming generally with the outer contour of the coil assembly, is mounted over the outside of the assembly and fixed thereto. The yoke ring 22 surrounds the coil assembly with its front and rear ends, base, face disposed against an inner portion of the radially-extending part of the coil assembly while its rear, neck, end terminates over an intermediate part of the coil assembly. There are second void spaces 54 between the yoke ring 22 and the field deflection coils 18.

The yoke ring 22 is a sintered molding of soft-magnetic material. The yoke ring 22 serves to short-circuit the magnetic lines of flux outside the coils, which are generated by the field deflection coils during operation. In this way, unwanted external magnetic stray fields are reduced and the sensitivity of the line deflection is increased. Although the presence of the yoke ring 22 helps to reduce these magnetic stray fields, a small external magnetic field still remains and a further reduction of this field is desired.

FIG. 2 is a perspective view of a field deflection coil 18 to be used in the deflection unit as shown in FIG. 1. The field deflection coil 18 comprises wire strands 50 and has first void spaces 52 between the wire strands 50.

The first and second void spaces 52, 54 are filled with a magnetic material 56. The magnetic material 56 serves to further short-circuit the reminant magnetic flux lines and thus a reduction of the external magnetic stray fields is obtained.

By filling the first and second void spaces 52, 54, the magnetic volume of the line deflection field is reduced, leading to a smaller value of the so-called magnetic blind energy $LI^2$ (L being the inductance of the coil, and I being the current flowing through the coil) and hence to a higher sensitivity of the line deflection. The sensitivity of the line deflection coil 17 can be increased by 5 to 10%. Preferably, a magnetic material 56 having a value for the relative magnetic permeability $\mu_r \geqq 10$ is chosen. In practice, a value of $\mu_r$ between 10 and 15 was realized.

Appropriate methods of filling the voids are injection molding and insertion molding. In the case of injection molding, a material is caused to flow out of a nozzle into the voids after application of a pressure to a reservoir containing the material. By applying a subsequent heating or a drying step, the material is made immobile in the voids. Another filling method is provided by insertion molding. In the case of insertion molding, the object to be filled is surrounded by a dedicated mold, whereafter the voids are filled with the material under a relatively high pressure. In this way, a good degree of filling the voids is obtained.

Good results were obtained with a plastic deformable magnetic material, comprising a resinous material, which contains a filler of magnetic particles, such as plasto-ferrite. The plastic deformability of the material results in a good accommodation to the local shape of the void spaces.

Additionally, the resinous material can be advantageously used for adhering the yoke ring 22 to the field deflection coils 18. This further improves the functionality of the yoke ring 22.

In summary, the invention relates to a deflection unit 10 for cathode ray tubes in which the external magnetic stray fields are further reduced and the sensitivity of the line deflection coils 17 is increased. This is done by applying a (preferably plastic deformable) magnetic material 56 in the first void spaces 52 between the wire strands 50 of the field deflection coils 18 and/or the second void spaces 54 between the field deflection coils 18 and the yoke ring 22. The plastic deformable magnetic material 56 can be additionally used for adhering the yoke ring 22 to the field deflection coils 18.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim.

What is claimed is:

1. A deflection unit (10) for a cathode ray tube (14), the deflection unit (10) comprising:

a line deflection coil (17), a field deflection coil (18) surrounding the line deflection coil (17), the field deflection coil (18) comprising wire strands (50) and having first void spaces (52) between the wire strands (50), and a yoke ring (22) surrounding the field deflection coil (18), second void spaces (54) being present between the field deflection coil (18) and the yoke ring (22), characterized in that the first and/or second void spaces (52, 54) are filled with a magnetic material (56).

2. A deflection unit (10) for a cathode ray tube (14) as claimed in to claim 1, characterized in that the magnetic material (56) comprises a plastic deformable magnetic material (56).

3. A deflection unit (10) for a cathode ray tube (14) as claimed in claim 2, wherein the deformable magnetic material (56) comprises a resinous material, which comprises a filler of magnetic particles.

4. A deflection unit (10) for a cathode ray tube (14) as claimed in claim 3, characterized in that the yoke ring (22) is adhered to the field deflection coil (18) by means of the resinous material (56).

5. A cathode ray tube assembly (10,14) comprising a deflection unit (10) as claimed in claim 1.

6. A method of manufacturing a deflection unit (10) for a cathode ray tube, comprising the steps of:

producing a line deflection coil (17), mounting a field deflection coil (18) around the line deflection coil (17), the field deflection coil (18) comprising wire strands (50) and having first void spaces (52) between the wire strands (50), and mounting a yoke ring (22) around the field deflection coil (18), the assembly having second void spaces (54) between the field deflection coil (18) and the yoke ring (22), characterized in that the first and/or second void spaces (52, 54) are filled with a magnetic material (56).

7. A method of manufacturing a deflection unit (10) as claimed in claim 6, characterized in that the filling step comprises injection molding of the magnetic material (56) in the first and/or second void spaces (52,54).

8. A method of manufacturing a deflection unit (10) for a cathode ray tube as claimed in claim 6, characterized in that the filling step comprises insertion molding of the magnetic material (56) in the first and/or second void spaces (52,54).

* * * * *